US006315123B1

(12) United States Patent
Ikeda

(10) Patent No.: US 6,315,123 B1
(45) Date of Patent: Nov. 13, 2001

(54) CARTON WITH PANEL LOCKING MEANS

(75) Inventor: Tamio Ikeda, Kawasaki (JP)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/486,577

(22) PCT Filed: Aug. 20, 1998

(86) PCT No.: PCT/JP98/17317

§ 371 Date: Jul. 17, 2000

§ 102(e) Date: Jul. 17, 2000

(87) PCT Pub. No.: WO99/11538

PCT Pub. Date: Mar. 11, 1999

(30) Foreign Application Priority Data

Aug. 29, 1997 (JP) ..... 9-235208

(51) Int. Cl.[7] ..... B65D 5/42; B65D 75/08

(52) U.S. Cl. ..... 206/434; 206/140; 229/103.2; 229/198.2

(58) Field of Search ..... 206/140, 141, 206/427, 439; 229/198.2, 183, 103.2

(56) References Cited

U.S. PATENT DOCUMENTS

| | | | | |
|---|---|---|---|---|
| 4,077,095 | | 3/1978 | Oliff . | |
| 4,093,116 | | 6/1978 | Watkins et al. . | |
| 4,424,901 | * | 1/1984 | Lanier | 206/434 |
| 4,533,047 | * | 8/1985 | Calvert | 206/434 |
| 4,545,485 | * | 10/1985 | Oliff | 206/434 |
| 5,000,313 | * | 3/1991 | Oliff | 206/140 |
| 5,060,792 | * | 10/1991 | Oliff | 206/140 |
| 5,443,203 | * | 8/1995 | Sutherland | 229/198.2 |
| 5,671,845 | * | 9/1997 | Harris | 206/434 |
| 5,765,685 | * | 6/1998 | Roosa | 206/434 |

* cited by examiner

*Primary Examiner*—Bryon P. Gehman
(74) *Attorney, Agent, or Firm*—Tsugihiko Suzuki

(57) ABSTRACT

A carton includes first and second overlapping panels and a lock for securing the panels together. The lock includes a locking tab and a retaining tab. The locking tab is joined at its one end edge to the first panel while the retaining tab defines a locking aperture and is connected at its one end edge to one end edge of the locking aperture. The locking tab is folded and received in the locking aperture. The retaining tab is folded and disposed at a folded position where the locking tab leans against the retaining tab. The respective free end edges of the locking and retaining tabs are disposed over the same side of the second panel. One of the locking and retaining tabs comprises a tongue projecting from its free end edge while the other tab is provided with a complementary notch or aperture for receiving the tongue.

14 Claims, 9 Drawing Sheets

CARTON WITH PANEL LOCKING MEANS

BACKGROUND OF THE INVENTION

The present invention relates generally to a carton having a pair of panels secured together by locking means in a mutually overlapping relationship and, more particularly, to a carton having improved locking means that is hardly loosened or disengaged.

Wraparound paperboard cartons have been known as means for packaging in one unit a plurality of beverage cans or bottles. To form packages with wraparound cartons, the carton blanks are supplied to a packaging machine where each blank is applied to the exterior of a group of cans or bottles followed by interlocking of the opposite ends of the respective blank by a suitable means such as an adhesive. By this means, each blank is formed into a tubular carton.

As an alternative to adhesives, the so-called mechanical locks have been used to secure the opposite ends of carton blanks. An example of the mechanical lock may be found by reference to U.S. Pat. No. 4,077,095 which is hereby incorporated by reference. The mechanical lock disclosed in this patent is a locking means for securing together the first and second opposite end panels of a blank in an overlapping relationship. The locking means comprises a locking tab struck from the first panel, a retaining tab struck from the second panel and a locking aperture defined by the retaining tab in the second panel. The locking tab is foldably joined at its proximal end to the first panel whereas the retaining tab is foldably joined at its proximal end to the second panel. The blank is applied to a group of articles, and then the first and second panels are controlled to be in an overlapping relationship to form a composite bottom wall of the carton whereupon the locking tab is folded upward into the locking aperture. When the locking tab is moved into the aperture, the retaining tab is thrust aside by the locking tab and is thereby folded upward to define an angle with the second panel. This brings the retaining tab into abutment at its free end against the lower side of the locking tab, which in turn retains the locking tab in the folded position. In this manner, the locking tab is held in the locking aperture with the perimeter of the aperture in engagement with the locking tab.

Another example is illustrated in U.S. Pat. No. 4,093,116 owned by the applicant. There is disclosed a panel interlocking arrangement comprising a locking tab arranged to be driven through a locking aperture defined by a retaining tab. Holding means is formed in the locking tab for receiving the free end of the retaining tab to hold the locking tab and the retaining in angular based relation to each other. There further comprises a securing tab projecting from the transverse edge of the locking aperture which is disposed within a securing aperture disposed at the base of the locking tab to positively secure the panels together against relative movement.

Wraparound cartons are tightly wound around groups of articles with no slack to assure that the articles are held inside the cartons. Therefore, the locking means such as mentioned above continually undergoes tension. If a carton with the locking means is subjected to vibration during, for example, its transportation, the locking tab could be unfolded to some degree, which in the worst case could result in disengagement of the retaining tab from the underside of the locking tab. Once the tabs are disengaged, the carton could be loosened to the extent that the accommodated articles are dislodged from the carton.

What is needed, therefore, is a wraparound carton having an improved locking means wherein unfolding of the locking tabs are practically inhibited

SUMMARY OF THE INVENTION

The invention in one form provides a carton having an improved locking means that can substantially reduce the risk of unfolding of locking tabs. The carton comprises first and second overlapping panels and locking means for securing the panels to each other. The locking means comprises a locking tab stuck from the first panel, the locking tab being foldably joined at one end thereof to the first panel and having an opposed free end, a retaining tab struck from the second panel and defining a locking aperture with opposed end edges. The returning tab is foldably connected to one of the opposed end edges wherein, the locking tab is foldably displaceable out of the plane of the first panel and received in the locking aperture along the other of the opposed end edges whereby the retaining tab is foldably displaced out of the plane of the second panel to put the locking tab into abutting relationship with the retaining tab, so that the locking tab is retained in the locking aperture. One of the locking tab and retaining tab comprises a tongue projecting from the free end edge thereof and the other of the locking tab and retaining tab is provided with complementary means for receiving the tongue to provide positive mutually locking components of the respective tabs. Preferably, the retaining tab may be folded in an angular relationship with the second panel, to abut the free end edge thereof of one of the opposite sides of the locking tab, whereby the locking tab is retained in the locking aperture.

According to an optional feature of this aspect of the invention the receiving means may be a notch formed along the free end edge of the retaining tab. Alternatively, the receiving means may be an engaging aperture formed in the retaining tab.

According to another optional feature of this aspect of the invention the locking tab may have a pair of opposed side edges extending between its hinged proximal and free end thereof, and the locking tab may include a wing projecting sideward from at least one of the side edges, the width of the locking tab at the wing being greater than the length of the one end edge of the locking aperture.

A second aspect of the invention provides a blank forming locking means for securing first and second panels in overlapping relationship which blank comprising a locking tab struck from the first panel. The locking tab is foldably joined at one end thereof to the first panel and having an opposed free end, a retaining tab struck from the second panel and defining a locking aperture with opposed end edges. The retaining tab is foldably connected to one of said end edges of the locking aperture. One of the locking tab and retaining tab comprises a tongue projecting from the free end edge thereof, and the other of the locking tab and retaining tab is provided with complementary means for receiving the tongue to provide positive mutually locking components of the respective tabs.

Optionally, the receiving means may be a notch formed along the free end edge of the retaining tab.

According to an optional feature of either aspect of the invention the locking means may further comprise an anchoring tab projecting from the one end of the locking aperture into the locking aperture. The locking tab is preferably provided near a proximal end edge thereof with an anchoring aperture for receiving the anchoring tab.

According to another optional feature of either aspect of the invention the locking aperture may have a pair of opposing side edges extending between the one and other end edges thereof, and the locking means may further comprise a stopper tab projecting from at least one of the opposed side edges of the locking aperture into the locking aperture, the width of the locking aperture at the stopper tab being less than that of the locking tab at the wing.

According to another optional feature of either aspect of the invention the tongue may be disposed at an intermediate position along the length of the free end edge of the one tab so that the free end edge of the one tab is interrupted by the tongue, and the one tab is disposed in abutment at the interrupted free end edge on one of opposite sides of the other tab whereby the other tab is retained in a folded position.

A third aspect of the invention provides panel interlocking means for securing first and second panels together comprising a locking tab struck from said first panel. The locking tab is foldably joined at one end thereof to said first panel and having an opposed free end, a retaining tab struck from said second panel and defining a locking aperture with opposed end edges. The retaining tab is foldably connected to one of said end edges of the locking aperture, said locking tab is foldably displaceable out of the plane of the first panel and received in said locking aperture by the opposing end edge whereby said retaining tab is foldably displaced out of the plane of the second panel to put the locking tab into abutting relationship with the retaining tab whereby said locking tab is retained in said locking aperture.

One of the locking tab or retaining tab comprises a tongue projecting from said free end edge thereof, and the other of the locking tab or retaining tab is provided with complementary means for receiving the tongue to provide positive mutually locking components of the respective tabs.

DETAILED DESCRIPTION OF THE PREFERRED EMBODIMENTS

Figure 1:
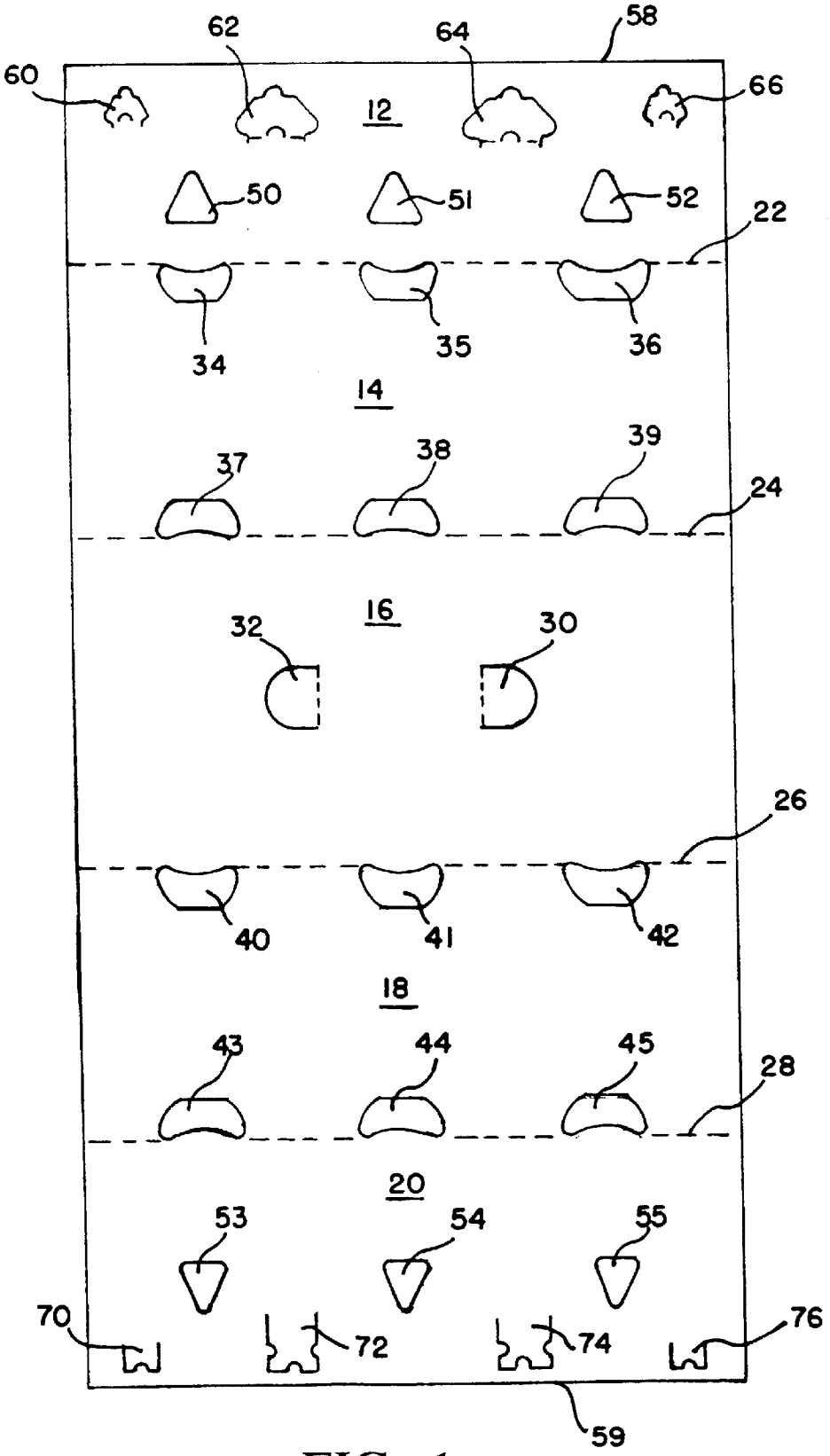
FIG. 1 is a plan view of the blank for forming a carton of an embodiment according to the present invention.

FIGS. 1–10 shows a carton according to the present invention. FIG. 1 illustrates a flat blank from which the carton is formed. The carton blank is formed of foldable material such as corrugated board, paperboard, plastic sheet or the like. The blank is essentially rectangular in shape and comprises a series of panels foldably joined one to next. Described from top to bottom in FIG. 1, the panel series include a first bottom panel 12, a first side panel 14, a top panel 16, a second side panel 18, and a second bottom panel 20. The first bottom panel 12 is foldably joined to the first side panel 14 along a fold line 22. The first side panel 14 is foldably joined to one of the opposite side edges of the top panel 16 along a fold line 24. The top panel 16 is foldably joined at the other side edge thereof to the second side panel 18 along a fold line 26. The second side panel 18 is foldably joined to the second bottom panel 20 along a fold line 28.

The top panel 16 has a pair of cushion tabs 30 and 32 struck therefrom. These tabs 30 and 32 define finger apertures in the top panel 16 which finger apertures are formed when the cushion tabs 30 and 32 are folded down by fingers. The first side panel 14 is formed along the fold lines 22 and 24 with article-receiving apertures 34–39 for receiving the opposite ends of articles such as cans. Likewise, the second side panel 18 has article-receiving apertures 40–45 along the fold lines 26 and 28. As well known, these apertures 34–45 serve as means for preventing dislodgement of the articles. The first bottom panel 12 has a plurality of triangular apertures 50–52 while the second bottom panel has similar apertures 53–55. These triangular apertures 50–55 serve as means for engagement with pulling elements of a packaging machine as will be described later.

The first bottom panel 12 is provided along the end edge 58 of the blank with a plurality of locking tabs 60, 62, 64 and 66. These locking tabs are struck from and foldably joined to the first bottom panel 12. The second bottom panel 20 is provided along the other end edge 59 of the blank with a plurality of retaining tabs 70, 72, 74 and 76. These retaining tabs are struck from and foldably joined to the second bottom panel 20. Each retaining tab, when folded with respect to the second bottom panel 20, leaves a locking aperture 120 (shown in FIG. 5) in the second bottom panel 20. Each locking aperture is designed to receive one of the locking tabs at a location opposing the respective retaining tab. More specifically, the locking tabs 60, 62, 64 and 66 make pairs respectively with the retaining tabs 70, 72, 74 and 76, and each locking tab in cooperation with the pairing retaining tab serves as locking means for interlocking the first and second bottom panels 12 and 20 in an overlapping relationship. The locking tabs 60 and 66 are identical in size and shape to each other and so do the locking tabs 62 and 64. The retaining tabs 70 and 76 are identical in size and shape to each other and so do the retaining tabs 72 and 74. Accordingly, only the locking tabs 60 and 62 and the retaining tabs 70 and 72 will hereinafter be described.

Figure 2:
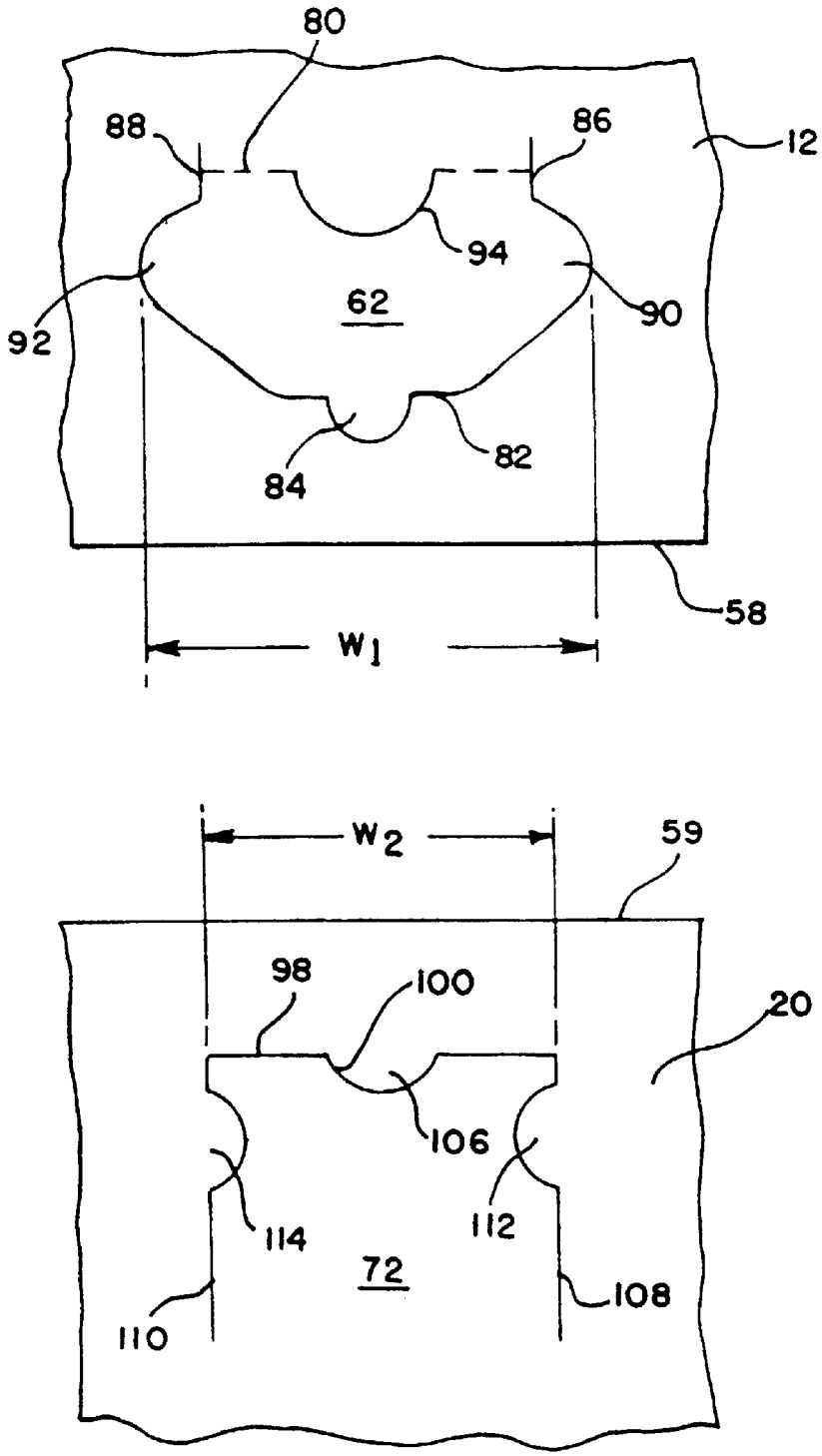
FIG. 2 is an enlarged plan view of one of the pairs of locking and retaining tabs in FIG. 1, showing the opposite end edges of the blank positioned in an opposed relationship.

In FIG. 2, the locking and retaining tabs 62 and 72 are shown in enlarged scale while the opposite end edges 58 and 59 of the carton blank are shown as opposed to each other. Stated differently, FIG. 2 illustrates a condition in which the first and second bottom panels 12 and 20 are about to be overlapped with each other. During the process of overlapping the panels 12 and 20, the locking and retaining tabs 62 and 72 are aligned with each other without changing their orientation as in FIG. 2. The locking tab 62 is foldably joined at its proximal end edge to the first bottom panel 12 along a fold line 80. The locking tab 62 extends from the fold line 80 to its free end edge 82 which is opposed and disposed parallel to the fold line 80. Provided at the mid position along the free end edge 82 of the locking tab 62 is a tongue 84 projecting therefrom toward the one end edge 58 of the blank. The locking tab 62 is also provided along its side edges 86 and 88 with outwardly extending wings 90 and 90. Further, the fold line 80 is interrupted by an arcuate slit 94 which extends between the two separate lengths of the interrupted fold line 80. This slit 94 cuts out a part of the locking tab 62 near the fold line 80. Thus, when the locking tab 62 is folded along the fold line 80, a semicircular anchoring aperture 96 (shown in FIG. 5) is formed in the locking tab 62.

Figure 5:
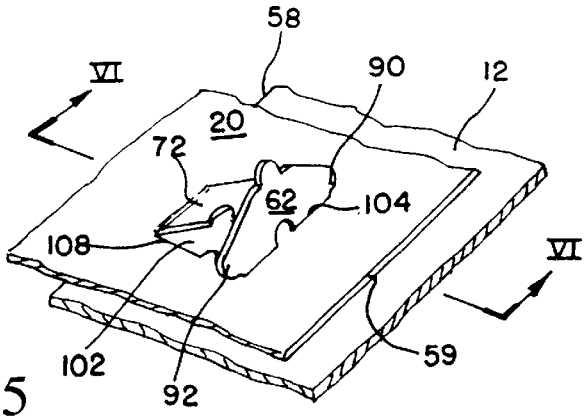
FIG. 5 is a perspective view of the locking and retaining tabs of FIG. 2 in an engaged condition.

As further shown in FIG. 2, the retaining tab 72 is formed from the second bottom panel 20 by a generally U-shaped slit so that the tab 72 defines in the second bottom panel 20 an locking aperture 102 (shown in FIG. 5). Although not shown in FIG. 2, an imaginary line extending between the opposite ends of the U-shaped slit defines the proximal end edge of the retaining tab 72. This proximal end edge is foldably joined to one of the opposite end edges of the locking aperture 102. Although not shown in FIG. 2, a fold line may be formed along the proximal end edge of the retaining tab 72 to facilitate folding of the retaining tab 72. However, to engage firmly with the locking tab 62, the retaining tab 72 is required to be resilient to some degree. Thus, whether such a fold line be provided should be determined depending on the nature and thickness of the sheet material of the blank. The retaining tab 72 extends from its proximal end edge to its free end edge 98 which is opposed and parallel to the proximal end edge of the tab 72. The mid portion of the free end edge 98 is curved convexly toward the proximal end edge of the retaining tab 72 such that a part of the retaining tab 72 along the free end edge 98 is cut out of the retaining tab 72. This arrangement results in a notch 100 (shown in FIG. 7) in the retaining tab 72 as well as an anchoring tab 106 projecting from the end edge 104 (shown in FIG. 5) into the anchoring aperture 102. Stated differently, the anchoring tab 106 is formed from the material cut out of the free end portion of the retaining tab 72 whereas the notch 100 is formed at the location from which the anchoring tab 106 is cut out. Further, the respective portions of the opposite side edges of the retaining tab 72 adjacent to its free end edge 98 are curved convexly toward each other. This creates a pair of stopper tabs 112 and 114 projecting respectively from the opposite side edges 108 and 110 of the locking aperture 102 toward each other. The distance between the proximal end edge (i.e., fold line 80) and the free end edge 82 of the locking tab 62 is preferably less than that between the proximal and free end edges of the retaining tab 72. The width W1 (shown in FIG. 2) of the locking tab 62 including the wings 90 and 92, i.e., the maximum width of the locking tab 62, is greater than the length W2 (shown in FIG. 2) of the end edge 104 of the locking aperture 102. Thus, the width of the locking aperture 102 at the stopper tabs 112 and 114 is much less than the maximum width W1 of the locking tab 62.

Figure 3:
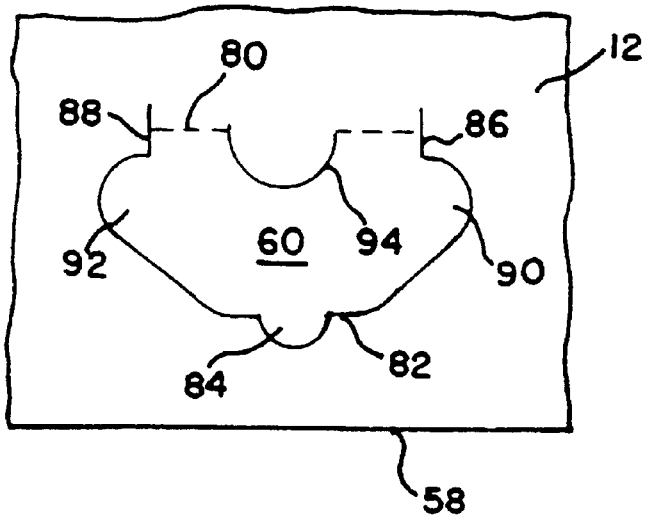
FIG. 3 is an enlarged plan view of another one of the pairs of locking and tabs in FIG. 1, showing the opposite end edges of the blank positioned in opposed relationship.
Figure 3:
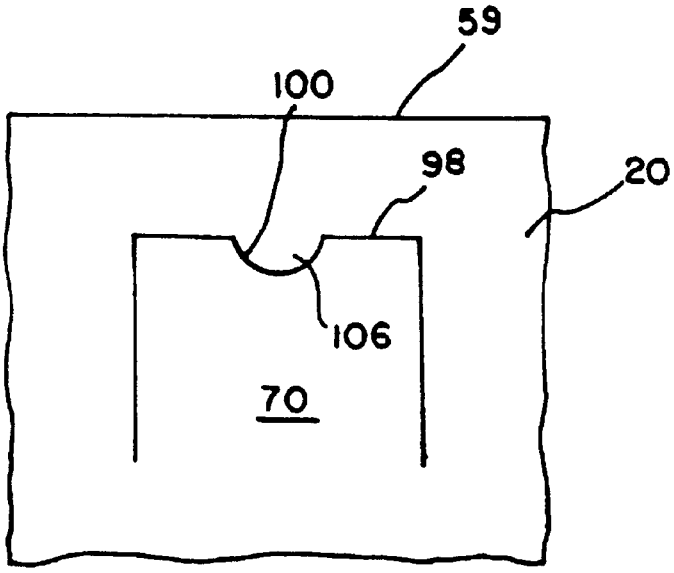

In FIG. 3, the locking and retaining tabs 60 and 70 are shown in enlarged scale while the opposite end edges 58 and 59 of the carton blank are shown as opposed to each other. The locking tab 60 is identical to the locking tab 62 except that it is smaller in size than the tab 62. Therefore, the parts of the locking tab 60 corresponding to those of the tabs 62 are designated by the like reference numerals, and descriptions of the corresponding parts are omitted. The retaining tab 70 is smaller in size than the retaining tab 72, and it differs from the tab 72 in that the opposite side edges of the tab 70 are straight rather than curved in part. Thus, the locking aperture defined by the tab 70 has no stopper tab projecting thereinto. The other parts of the retaining tab 70 are identical to the tab 72 and thus are designated by the like reference numerals.

Figure 4:
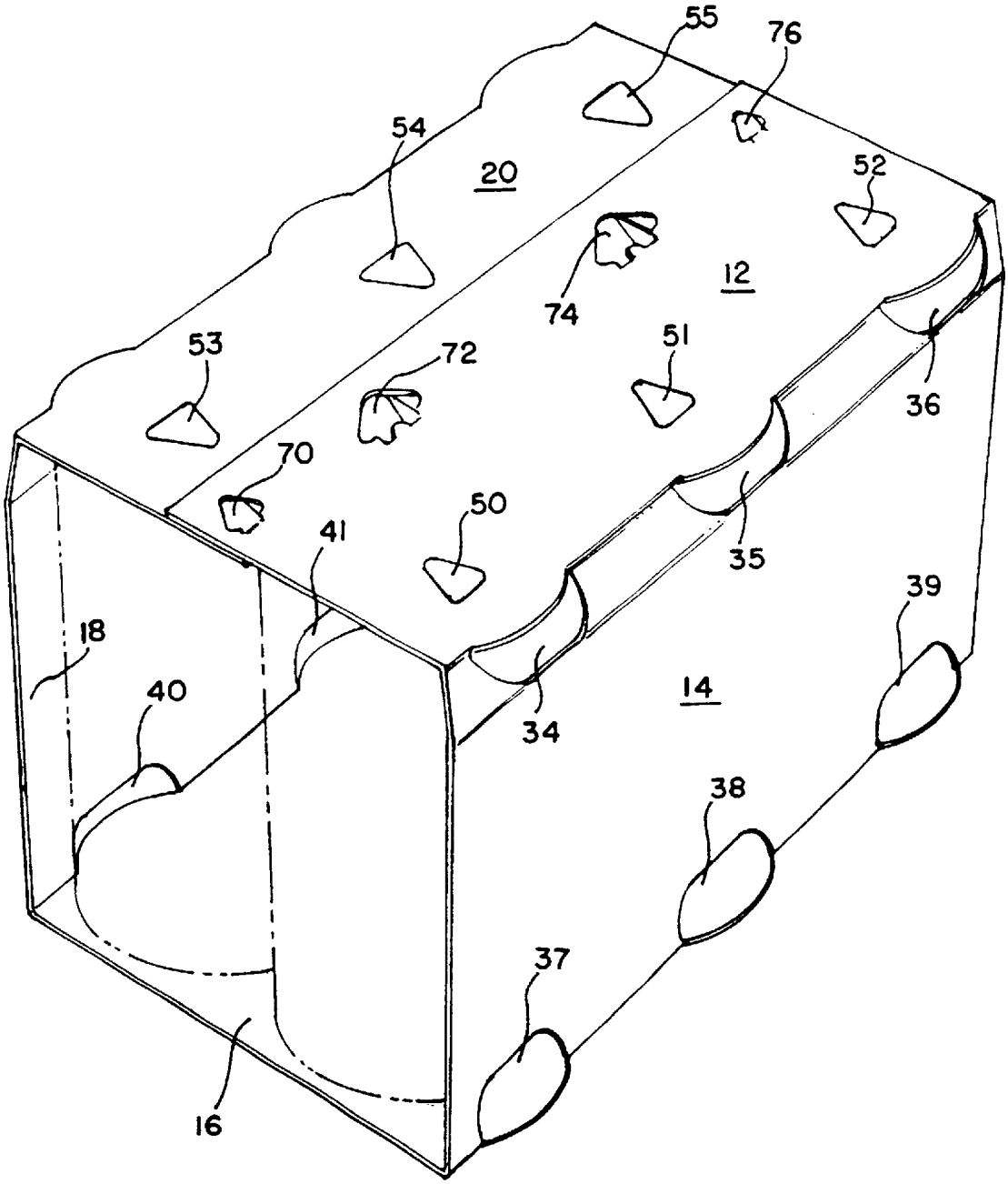
FIG. 4 is a perspective view of the carton formed from the blank of FIG. 1 in an inverted position.

The blanks having the above locking means are supplied to a packaging machine and each of them is placed over a group of articles. Pulling elements of the packaging machine are inserted into the triangular apertures 50–56 to move the first and second bottom panels 12 and 20 toward each other and to thereby bring them into overlapping relationship. In the overlapped condition, the first bottom panel 12 is laid over the second bottom panel 20 as shown in FIG. 4, and the proximal end edges (i.e., fold lines 80) of the locking tabs 60 and 62 are vertically aligned respectively with the free end edges 98 of the retaining tabs 70 and 72. The locking and retaining tabs of each aligned pair are then engaged together to interlock the first and second bottom panels 12 and 20 in the overlapping relationship, which results in the tubular carton shown in FIG. 4. The carton in FIG. 4 are shown in an inverted condition wherein the panels 12 and 20 in cooperation form a composite bottom wall of the carton. However, the two interlocked panels may instead be those for forming a top wall or a side wall.

Figure 7:
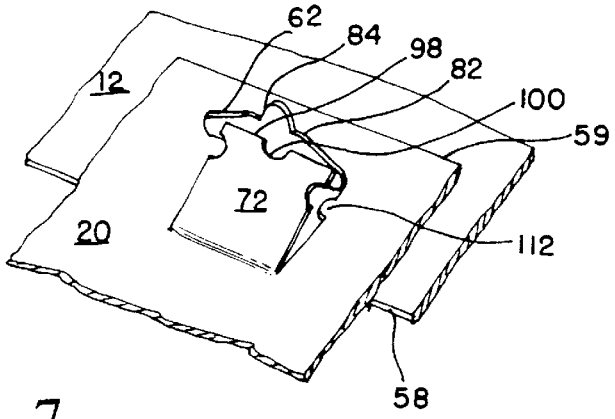
FIG. 7 is a top, left and rear perspective view of the locking and retaining tabs of FIG. 5.
Figure 6:
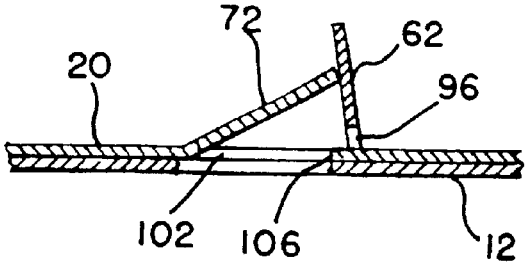
FIG. 6 is a view taken along the line VI—VI in FIG. 5.

Engagement of the locking and retaining tabs of each aligned pair is achieved typically by a part of a conventional packaging machine similar to the punching mechanism, which causes the locking tab to be inserted into the locking aperture. Referring to FIGS. 5–7, such an inserting process is described hereinbelow. When the locking tab 62 is folded relative to the first bottom panel 12 and inserted into the locking aperture 102, the retaining tab 72 is thrust aside by the locking tab 62 and thereby folded upwardly. By this means, the locking tab 62 clears the free end edge 98 of the retaining tab 72 and then leans against the retaining tab 72 as shown in FIG. 6. The locking tab 62 is thereby held in the folded position where it is disposed at an angle with respect to the second bottom panel 20. While in the folded position, the locking tab 62 is held in engagement at its proximal end edge with the end edge 104 of the locking aperture 102 and receives the anchoring tab 106 in its anchoring aperture 96 (shown in FIG. 6). The engagement between the anchoring tab 106 and the aperture 96 inhibits the locking tab 62 from being unintentionally withdrawn from the locking aperture 102. Unintentional withdrawal of the locking tab 62 is also inhibited by the wings 90 and 92 which engage the opposite side edges 108 and 110 of the locking aperture 102 as shown in FIG. 5. As best shown in FIG. 7, the retaining tab 72 is in abutment at its free end edge 98 against the lower side of the locking tab 62 and thereby supports the locking tab 62 from underneath. The retaining tab 72 is held at an angle with the second bottom panel 20 due to friction between the free end edge 98 and the lower side of the locking tab 62. As described above, the locking tab 62 while in the locking aperture 102 leans against the retaining tab 72 and thereby held in an angular relationship with the second bottom panel 20. The first and second bottom panels 12 and 20 are thereby interlocked.

Figure 9:
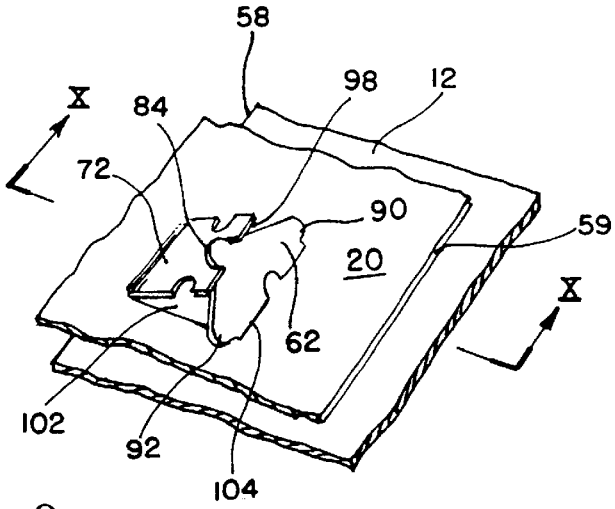
FIG. 9 is a perspective view of the locking and retaining tabs of FIG. 6 in a mutually braced condition wherein the locking tab has been somewhat unfolded to bring its tongue into the notch in the retaining tab.
Figure 10:
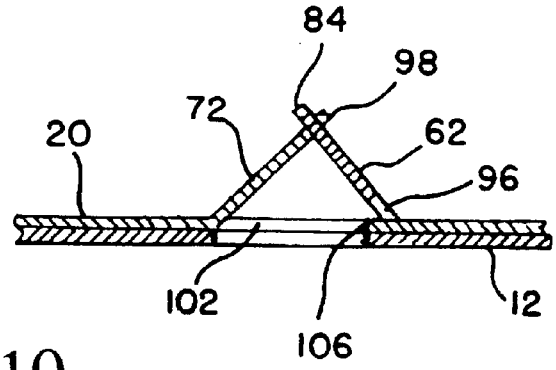
FIG. 10 is a view taken along the line X—X in FIG. 9.
Figure 8:
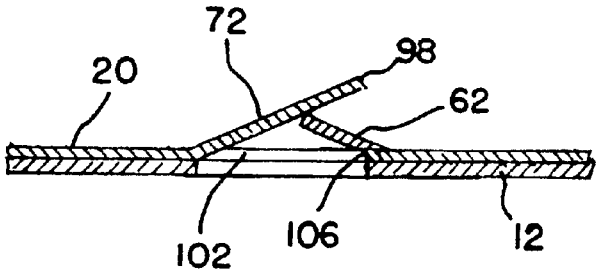
FIG. 8 is a cross section of the locking and retaining tabs of FIG. 6 in a loosened condition wherein the locking tab has been somewhat unfolded.

While engaged with the locking tab 62, the retaining tab 72 is merely pressed at its free end edge 98 against the lower side of the locking tab 62. Therefore, if the carton is vibrated during transportation for example, the free end edge 98 can slide upwardly along the lower side (i.e., the left side as viewed in FIG. 6) of the locking tab 62. If the free end edge 98 keeps sliding to the extent that it clears the free end edge 82 of the locking tab 62 and if the tabs 62 and 72 were without the tongue and notch, the locking tab 62 could unfold as shown in FIG. 8 wherein the angle of the locking tab 62 with the second bottom panel has been reduced and the engagement between the locking and retaining tabs 62 and 72 has been considerably loosened. In the above described invention, however, if the free end edge 98 clears the free end edge 82, the tongue 84 of the locking tab 62 is caught in the notch 100 of the retaining tab as best shown in FIG. 9. By this means, the locking tab 62 is restricted from unfolding. Once the tongue 84 is in the notch 100, the locking tab 62 leans at the tongue 84 against the retaining tab 72 while the retaining tab 72 leans against the free end edge 82 of the locking tab 62. In this condition, the locking and retaining tabs 62 and 72 are mutually braced and restrict each other's unfolding movement. The locking and retaining tabs 62 and 72 in the mutually braced condition is best shown in FIG. 10. If, by any chance, the locking tab 62 is unfolded to the position as shown in FIG. 8, the stopper tabs 112 and 114 cooperate with the wings 90 and 92 to prevent the locking tab 62 from completely withdrawn from the locking aperture 102.

The locking and retaining tabs 60 and 70 engage each other and react to vibrations in the same manner as the tabs 62 and 72.

Figure 11:
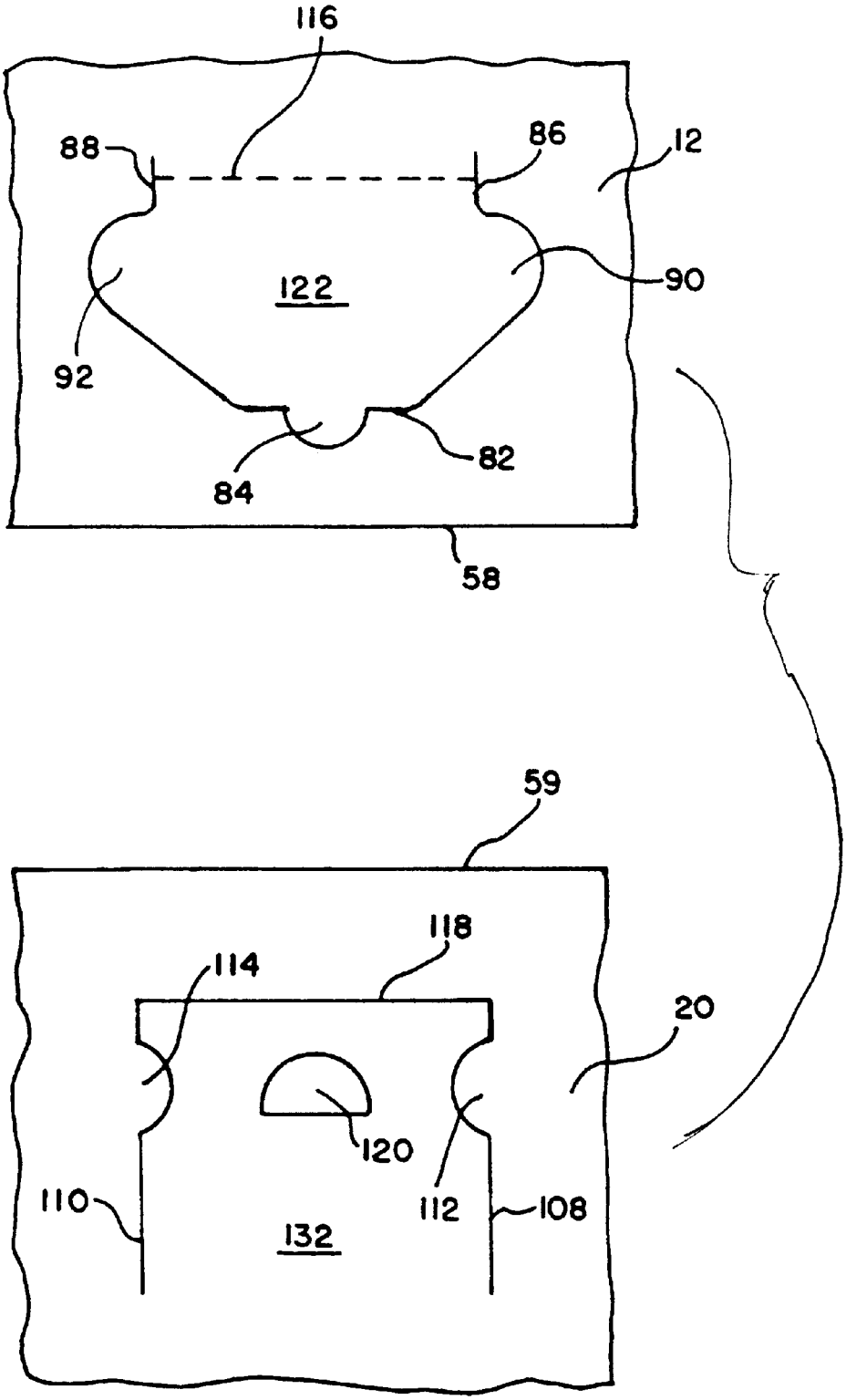
FIG. 11 is a plan view of the first modified form of the locking and retaining tabs in FIG. 2.
Figure 12:
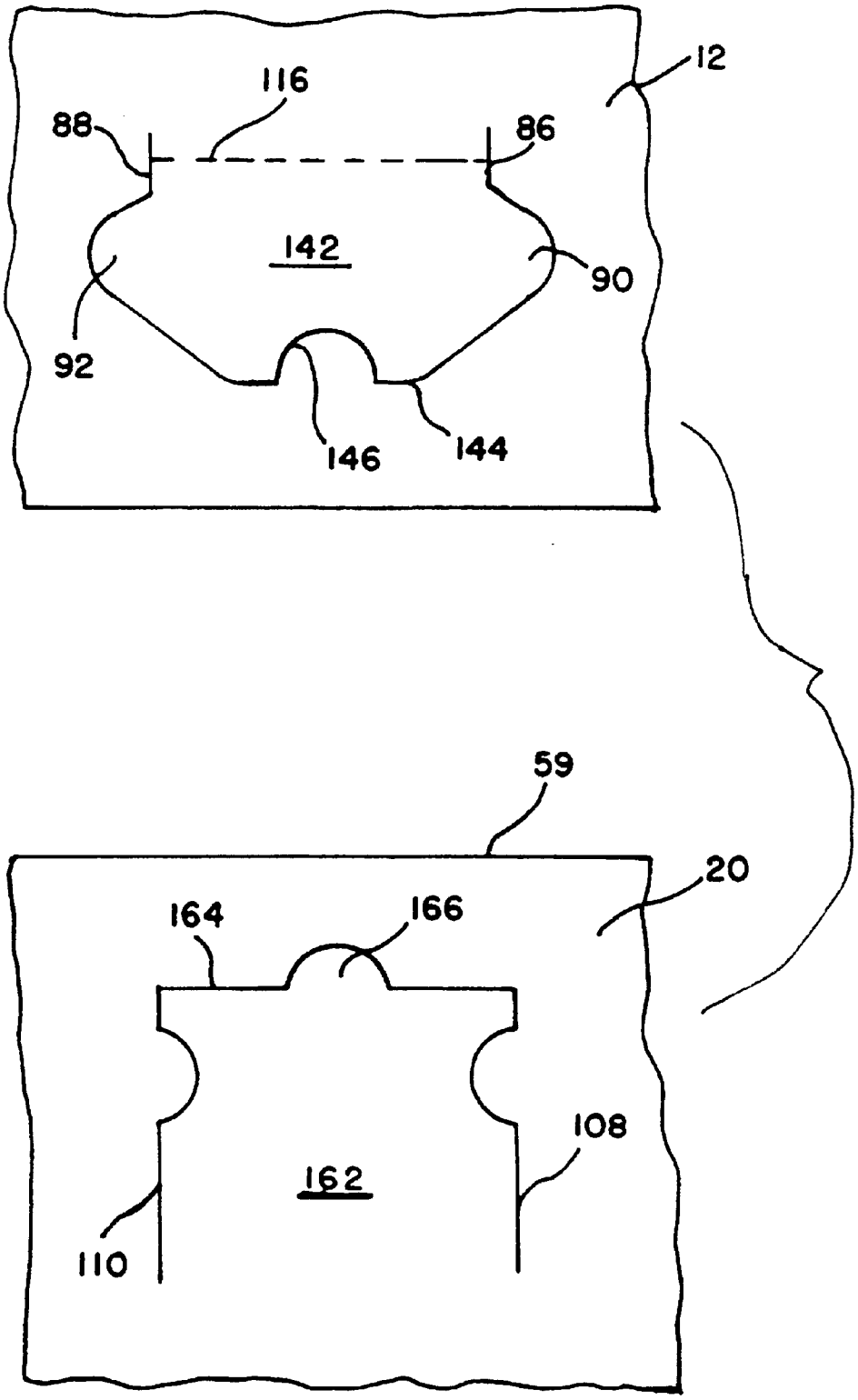
FIG. 12 is a plan view of the second modified form of the locking and retaining tabs in FIG. 2.
Figure 13:
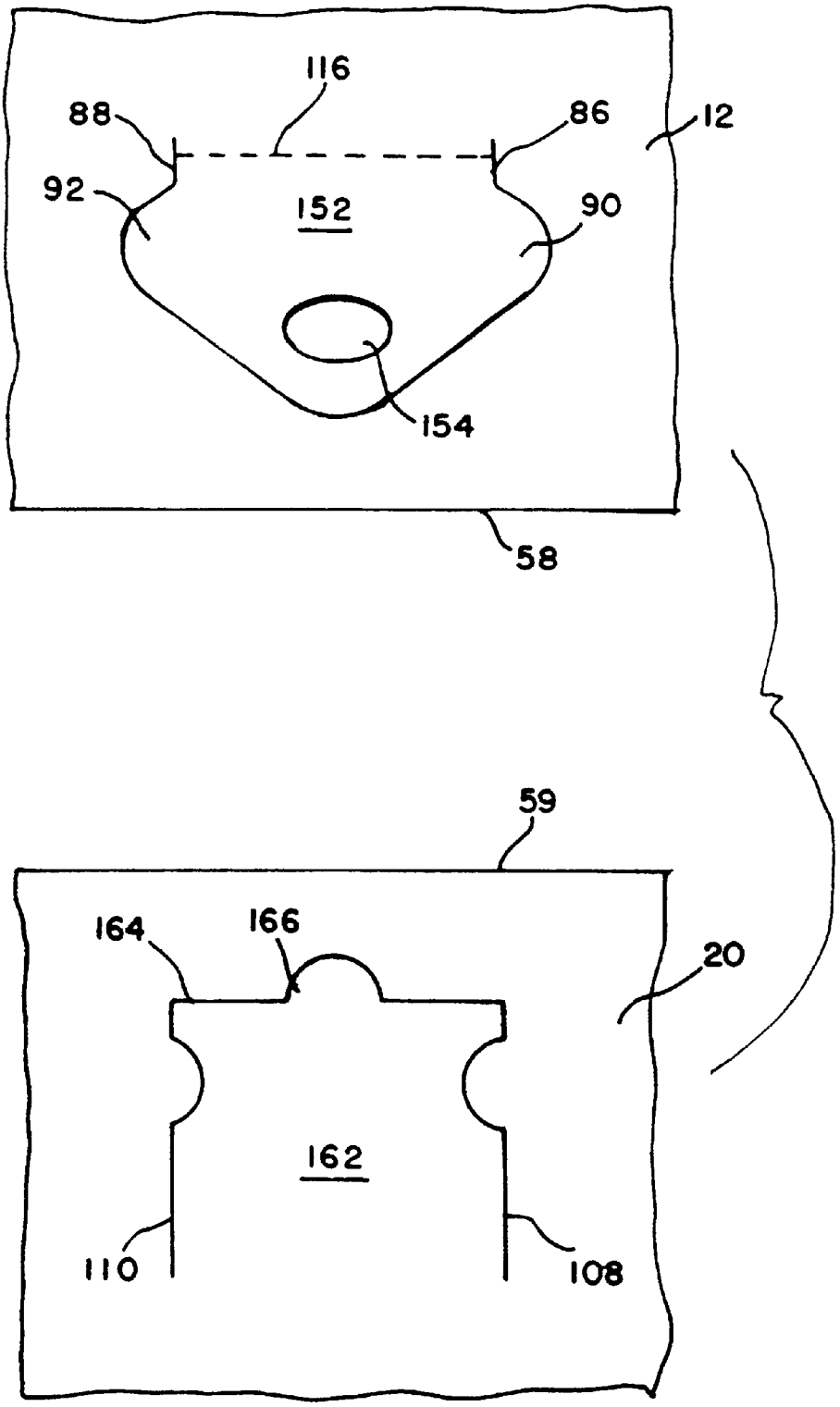
FIG. 13 is a plan view of he third modified form of the locking and retaining tabs in FIG. 2.

FIGS. 11–13 illustrate three different modified forms of the locking means in FIG. 2. Each of these modified form locking means may be used in place of the locking tabs 60, 62, 64 and 66 and the retaining tabs 70, 72, 74 and 76 to secure the first and second panels of wraparound cartons. In FIGS. 2 and 11–13, the like reference numerals designate the corresponding parts, and descriptions of the corresponding parts are omitted in the following description.

In FIG. 11, the proximal end edge of the locking tab 122 is foldably joined to the first bottom panel 12 along a continuous fold line 116. Thus, the locking tab 122 has no anchoring aperture. The remainder of the locking tab 122 is identical to the locking tab 62. The free end edge 118 of the retaining tab 132 is straight and has no curvature. The retaining tab 132 has no notch along its free end edge 118. In place of a notch, however, the retaining tab 132 is provided adjacent to tits free end edge 118 with a semicircular engaging aperture 120. The remainder of the retaining tab 132 is identical to the retaining tab 72. Because the retaining tab 132 has no notch, the locking aperture in this modified form has no anchoring tab.

Except for the function of the anchoring tab and the anchoring aperture, the function of the locking and retaining tabs 122 and 132 as well as the process of engaging them together are substantially identical to those of the tabs 62 and 72. The performance of the tabs 122 and 132 under vibration is also substantially the same as that of the tabs 62 and 72 except that the tongue 84 is received in the engaging aperture 120 rather than in a notch.

The locking means in FIGS. 12 and 13 differ from that in FIG. 11 in that the tongue is formed along the free end edge of the respective retaining tab rather than on the locking tab, and the receiving means for receiving the tongue is formed in the respective locking tab rather than in the retaining tab. In FIG. 12, the retaining tab 162 is provided at the mid position along the free end edge 164 with a tongue 166. The means for receiving the tongue 166 is provided by the notch 146 in the locking tab 142 which notch is formed along the free end edge 144. In the arrangement of FIG. 12, the tongue 166 is caught by the notch 146 as soon as the locking tab 142 clears the free end edge 164 of the retaining tab 162 during its inserting process. Once the tongue 166 is received in the notch 146, the retaining tab leans at its tongue 166 against the locking tab 146, and the locking tab 142 leans against the free end edge 164 of the retaining tab 162. In this condition, the tabs 142 and 162 brace each other and restrict each other from unfolding downwardly.

The retaining tab 162 in FIG. 13 is completely identical to that in FIG. 12. In this modified form, however, the means for receiving the tongue 166 of the retaining tab 162 is provided by the engaging aperture 154 in the locking tab 152. The engaging process of this locking means is the same as that of the second modified form in FIG. 12. In the third modified form, however, the engagement between the engaging aperture 154 and the tongue 166 prevent not only downward unfolding movement of the tabs 152 and 162 but also upward movement of the retaining tab 162. That is to say, the retaining tab 162 has a very little risk of disengagement from the lower side of the locking tab 152, which in turn prevents unintentional unfolding of the locking tab 152 almost perfectly.

It will be recognized that many variations may be made to the foregoing within the scope of the present invention. For example, the present invention is not limited to the cartons for packaging two rows of cans such as shown in FIG. 4 but may be used with those for packaging one or more than two rows of cans, bottles or other generally cylindrical articles. It should, however, be recognized that in case odd number row(s) (e.g., one row, three rows or the like) of cans are packaged, the locking means must be located at the position somewhat closer to one of the side panels rather than at the middle between the side panels, and thus the widths of the first and second bottom panels may be different from each other. For example, when cans in a single row are packaged, either locking or retaining tab must be located in the first or second bottom panel along the lower edge of the adjacent one of the side panels, and thus one of the first and second bottom panels may be extended entirely across the width of the package.

It should be also recognized that the present invention is not limited to the cartons consisting of five panels such as shown in FIG. 1, but may be used with any wraparound cartons which include those having a pair of shoulder strips between the top panel and the opposite side panels, those having a pair of heel strips between the bottom wall and the side panels and those having both the shoulder and heel strips. It should be further recognized that the present invention may be used even with non-wraparound type cartons as far as such cartons have a pair of overlapping panels which need to be interlocked. Such non-wraparound cartons should include multiple-piece cartons in which two or more blanks are interlocked to form a carton and tubular cartons in which at least one of its opposite open ends is closed by two or more overlapping end flaps.

According to the carton of the invention, if the locking tab is somewhat unfolded due, for example, to vibration, the tongue on one of the locking and retaining tabs is caught by the receiving means in the other tab and thereby further unfolding of the locking tab is restricted. According to the invention, the locking and retaining tabs brace each other, and thus the locking tab hardly unfolds even if subjected to vibration. In other words, the present invention, owing to the mutually braced engagement between the locking and retaining tabs, provides a carton with a high article-retaining capability.

What is claimed is:

1. A carton comprising first and second overlapping panels and locking means for securing said panels to each other, said locking means comprising a locking tab struck from said first panel, the locking tab being foldably joined at one end edge thereof to said first panel, and a retaining tab struck from said second panel and defining a locking aperture with opposed end edges, the retaining tab being foldably connected at one end edge thereof to one of said opposed end edges of said locking aperture, wherein said locking tab is folded out of the plane of the first panel and received in said locking aperture along the other of said opposed end edges of said locking aperture, said retaining tab is folded out of the plane of the second panel and disposed at a folded position where said locking tab leans against said retaining tab whereby said locking tab is retained in said locking aperture, said locking tab has a free end edge opposed to said one end edge of said locking tab, said retaining tab has a free end edge opposed to said one end edge of said retaining tab, said free end edges of said locking and retaining tabs are disposed over one side of said second panel, one of said locking tab and said retaining tab comprises a tongue projecting from said free end edge of said one tab, and the other of said locking tab and said retaining tab is provided with complementary means for receiving said tongue to provide positive mutually locking components of the respective tabs.

2. The carton as claimed in claim 1 wherein said free end edge of said retaining tab abuts on one of opposite sides of said locking tab.

3. The carton according to claim 1, wherein said receiving means is a notch formed along said free end edge of said other tab.

4. The carton according to claim 1, wherein said receiving means is an engaging aperture formed in said other tab.

5. The carton according to claim 1, wherein said locking means further comprises an anchoring tab projecting from said other end edge of said locking aperture into said locking aperture, and said locking tab is provided near said one end edge of said locking tab with an anchoring aperture for receiving said anchoring tab.

6. The carton according to claim 1, wherein said locking tab has a pair of opposing side edges extending between said one and free end edges of said locking tab, and the locking tab includes at least one wing projecting side ward from at least one of said side edges, the width of said locking tab at said wing being greater than the length of said other end edge of said locking aperture.

7. The carton according to claim 1, wherein said locking aperture has a pair of opposing side edges extending between said one and other end edges of said locking aperture, and said locking means further comprises at least one stopper tab projecting from at least one of said side edges of said locking aperture into said locking aperture, the width of said locking aperture at said stopper tab being less than that of said locking tab.

8. The carton according to claim 1, wherein said tongue is disposed at an intermediate position along the length of said free end edge of said one tab so that said free end edge of said one tab is interrupted by said tongue, and said one tab is disposed in abutment at said interrupted free end edge on one of opposite sides of said other tab whereby said other tab is retained in a folded position.

9. The carton as claimed in claim 1 formed from a blank.

10. A blank for forming locking means for securing first and second panels in overlapping relationship, said blank comprising a locking tab struck from said first panel, the locking tab being foldably joined at one end edge thereof to said first panel, and a retaining tab struck from said second panel and defining a locking aperture for receiving said locking tab, said locking aperture having opposed end edges, the retaining tab being foldably connected at one end edge thereof to one of said end edges of the locking aperture, wherein said locking tab has a free end edge opposed to said one end edge of said locking tab, said retaining tab has a free end edge opposed to said one end edge of said retaining tab, one of said locking tab and said retaining tab comprises a tongue projecting from said free end edge of said one tab, and the other of said locking tab and said retaining tab is provided along said free end edge of said other tab with a notch for receiving said tongue to provide mutually locking components of the respective tabs.

11. The blank as claimed in claim 10, wherein said locking means further comprises an anchoring tab projecting from said other end edge of said locking aperture into said locking aperture, and said locking tab is provided near said one end edge of said locking tab with an anchoring aperture for receiving said anchoring tab.

12. The blank as claimed in claim 10, wherein said locking aperture has a pair of opposing side edges extending between said one and other end edges of said locking aperture, and said locking means further comprises at least one stopper tab projecting from at least one of said side edges of said locking aperture into said locking aperture, the width of said locking aperture at said stopper tab being less than that of said locking tab.

13. The blank as claimed in claim 10, wherein said tongue is disposed at an intermediate position along the length of said free end edge of said one tab so that said free end edge of said one tab is interrupted by said tongue.

14. Panel interlocking means for securing first and second panels together, comprising a locking tab struck from said first panel, the locking tab being foldably joined at one end edge thereof to said first panel, and a retaining tab struck from said second panel and defining a locking aperture with opposed end edges, the retaining tab being foldably connected at one end edge thereof to one of said end edges of the locking aperture, wherein said locking tab is folded out of the plane of the first panel and received in said locking aperture by the other of said end edges of said locking aperture, said retaining tab is folded out of the plane of the second panel and disposed at a folded position where said locking tab leans against said retaining tab whereby said locking tab is retained in said locking aperture, said locking tab has a free end edge opposed to said one end edge of said locking tab, said retaining tab has a free end edge opposed to said one end edge of said retaining tab, said free end edges of said locking and retaining tabs are disposed over one side of said second panel, one of said locking and retaining tabs comprises a tongue projecting from said free end edge of said one tab, and the other of said locking and retaining tabs is provided with complementary means for receiving said tongue to provide positive mutually locking components of the respective tabs.

* * * * *